United States Patent [19]

Eberhardt

[11] 4,357,930

[45] Nov. 9, 1982

[54] HEATING SYSTEM FOR FIREPLACES

[76] Inventor: H. Alfred Eberhardt, 1630 Harvard La., Paoli, Pa. 19301

[21] Appl. No.: 256,310

[22] Filed: Apr. 22, 1981

[51] Int. Cl.[3] ..... F24B 7/00

[52] U.S. Cl. ..... 126/121; 165/DIG. 2; 237/51

[58] Field of Search ..... 126/121, 143, 123, 120, 126/105 A, 110 R, 299 D; 237/51, 55; 165/DIG. 2, 147; 98/115 R

[56] References Cited

U.S. PATENT DOCUMENTS

| | | | |
|---|---|---|---|
| 1,568,816 | 1/1926 | Ellson | 126/121 |
| 2,375,318 | 5/1945 | Mudgett | 126/121 |
| 2,421,371 | 6/1947 | Budlane | 126/147 |
| 3,736,961 | 6/1973 | Walsh | 165/DIG. 2 |
| 3,930,491 | 1/1976 | Miller | 126/121 |
| 4,049,196 | 9/1977 | Bergami, Jr. et al. | 126/121 |
| 4,096,849 | 6/1978 | Moncrieff-Yeates | 126/121 |
| 4,103,669 | 8/1978 | Pauley | 126/121 |
| 4,112,914 | 9/1978 | Brown | 126/121 |
| 4,112,915 | 9/1978 | Slavik | 126/121 |
| 4,120,281 | 10/1978 | Wass | 126/121 |

FOREIGN PATENT DOCUMENTS 2750484 5/1979 Fed. Rep. of Germany ... 165/DIG. 2

*Primary Examiner*—Samuel Scott
*Assistant Examiner*—Randall L. Green
*Attorney, Agent, or Firm*—Harding, Earley & Follmer

[57] ABSTRACT

A system for heating the air in the room containing a fireplace includes a heat exchanger mounted at the top portion of the combustion chamber of the fireplace to extend across the chimney flue opening and a fan for circulating room air through the heat exchanger in heat exchange relationship with the combustion gases passing from the combustion chamber through a spin inducing heat exchange passage in the heat exchanger to the chimney flue opening.

11 Claims, 7 Drawing Figures

FIG. 2
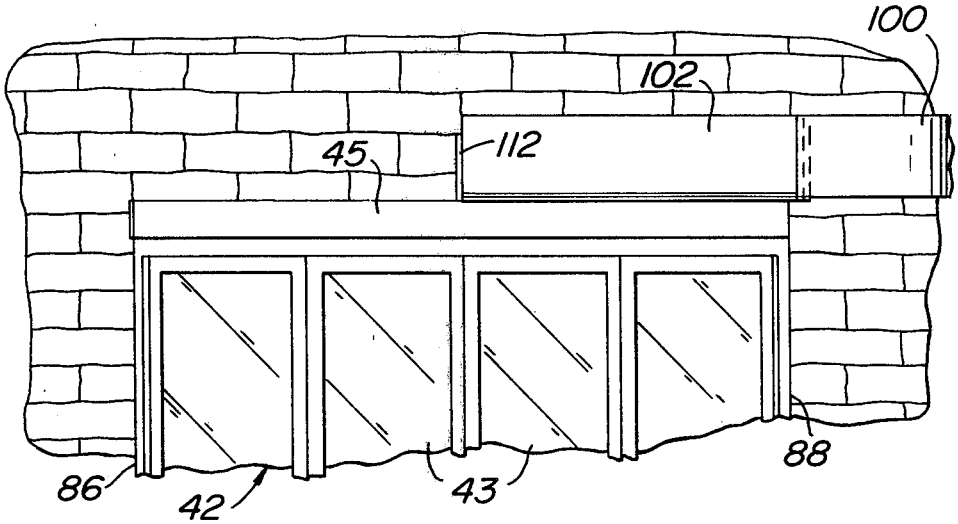
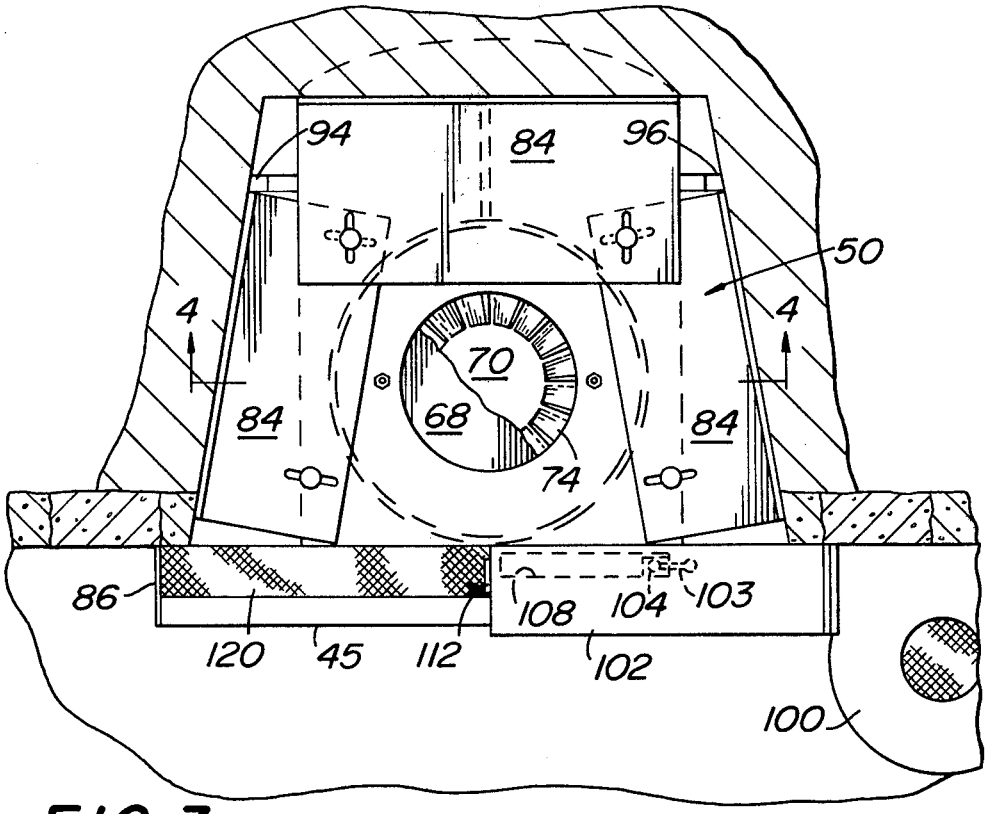
FIG. 3

FIG. 4
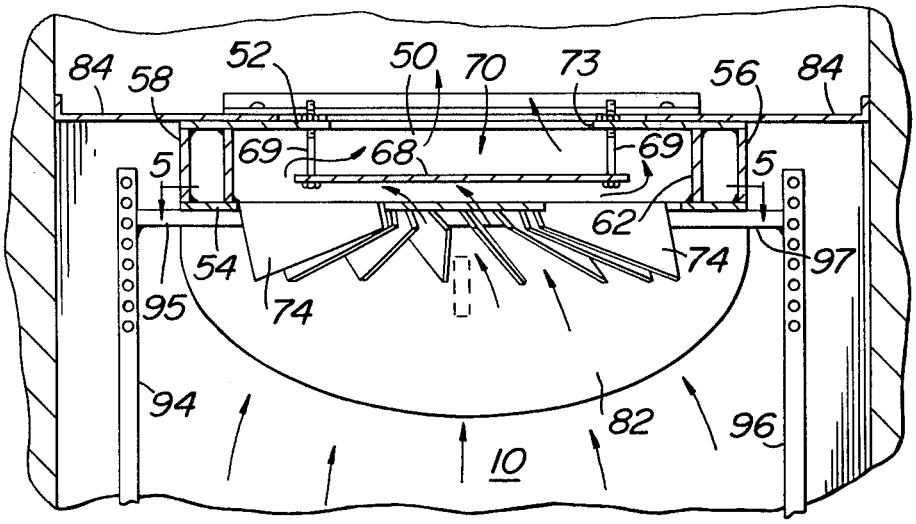
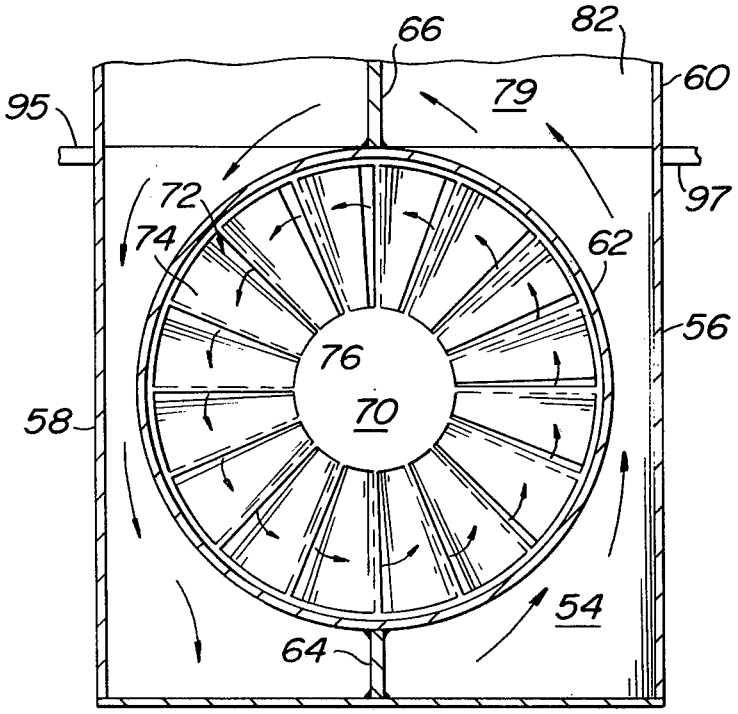
FIG. 5

HEATING SYSTEM FOR FIREPLACES

BACKGROUND AND SUMMARY OF THE INVENTION

Conventional fireplaces are not very effective sources of heat for the room in which they are located primarily because the fire draws heated air from the room and large amounts of outside air into the house to meet the combustion requirements of the fire. This causes drafts of cold air along the floor of the room and the cooling of the house.

As is described in my copending application, Ser. No. 34,424, the heating effectiveness of a fireplace is greatly increased by the provision of an air distributor in cooperation with means for supplying outside air to an opening in the hearth of the fireplace. The air supply may comprise a flow path including the ash pit opening in the hearth with the air being supplied from the basement or other house area whereby relatively cold air is supplied to the fire. Also, the ash pit opening may be supplied with air from the outside of the house. The air distributor is constructed and arranged to be positioned to direct the flow of air passing through the hearth opening toward the front opening of the combustion chamber for discharge at that location so that the air passes to the fire to meet the combustion requirements thereof and upwardly through the chimney flue. Accordingly, relatively cold outside air is supplied to the fire to support the combustion thereof thereby substituting this cold air for the room air which conventional fireplaces utilize to feed the fire. Since the room air is normally heated by the home's heating system, the use of much less energy to feed the fire results in considerable savings in energy.

A further improvement to the above-described arrangement is to provide means for circulating the room air through the combustion chamber of the fireplace to draw heat from the combustion gases which would normally pass up the flue without providing any heating action to the room. While heat exchangers for room air are known, those in general use today have several disadvantages. For example, such prior art heat exchangers are generally large and cumbersome and are located at least partially near the bottom region of the combustion chamber. Also, when the prior art heat exchangers are inserted in existing fireplace openings, they severely limit the size of the viewing area and access doors.

It is the general object of the invention to provide a fireplace system for heating the room air by the use of a compact, heat exchanger which is light in weight and adapted to be installed in existing fireplaces.

A further object of the invention is to provide a heat exchanger of the indicated type which is constructed to provide a more complete combustion and a highly efficient heat exchange action. To this end the combustion gases are caused to spin with induced Coriolis forces while being exposed to a hot catalytic plate on their interior. Furthermore, the exterior of these hot spinning gases will have repeated exposure to the highly conductive heat exchanger wall for additional extraction of heat making the device extremely efficient in the removal of energy from the exhaust gases just before entry into the chimney flue.

A further object of the invention is to provide a heat exchanger construction which can be easily removed after a period of service for cleaning or the like.

Briefly stated, the fireplace heating system in accordance with the invention includes a heat exchanger, means for mounting the heat exchanger at the top portion of the combustion chamber to extend across a location where the chimney flue connects with the top portion of the combustion chamber, and fan means for circulating room air through the heat exchanger. The heat exchanger comprises means defining a heat exchange passage for the flow of room air and means defining a heat exchange and spin inducing passage for the flow of combustion gases from the combustion chamber to the chimney flue, such heat exchange passages being in heat exchange relationship so that the hot combustion gases heat up the room air being circulated through the heat exchanger by the fan means.

BRIEF DESCRIPTION OF THE DRAWINGS

FIG. 2 is a front view taken on line 2—2 of FIG. 1;

FIG. 3 is a plan view of the fireplace shown in FIG. 1 taken on line 3—3 of FIG. 1;

FIG. 4 is a front elevation, partly in section, of the heat exchanger shown in FIG. 1;

FIG. 5 is a sectional view taken on line 5—5 of FIG. 4;

DETAILED DESCRIPTION OF THE PREFERRED EMBODIMENT

Figure 1:
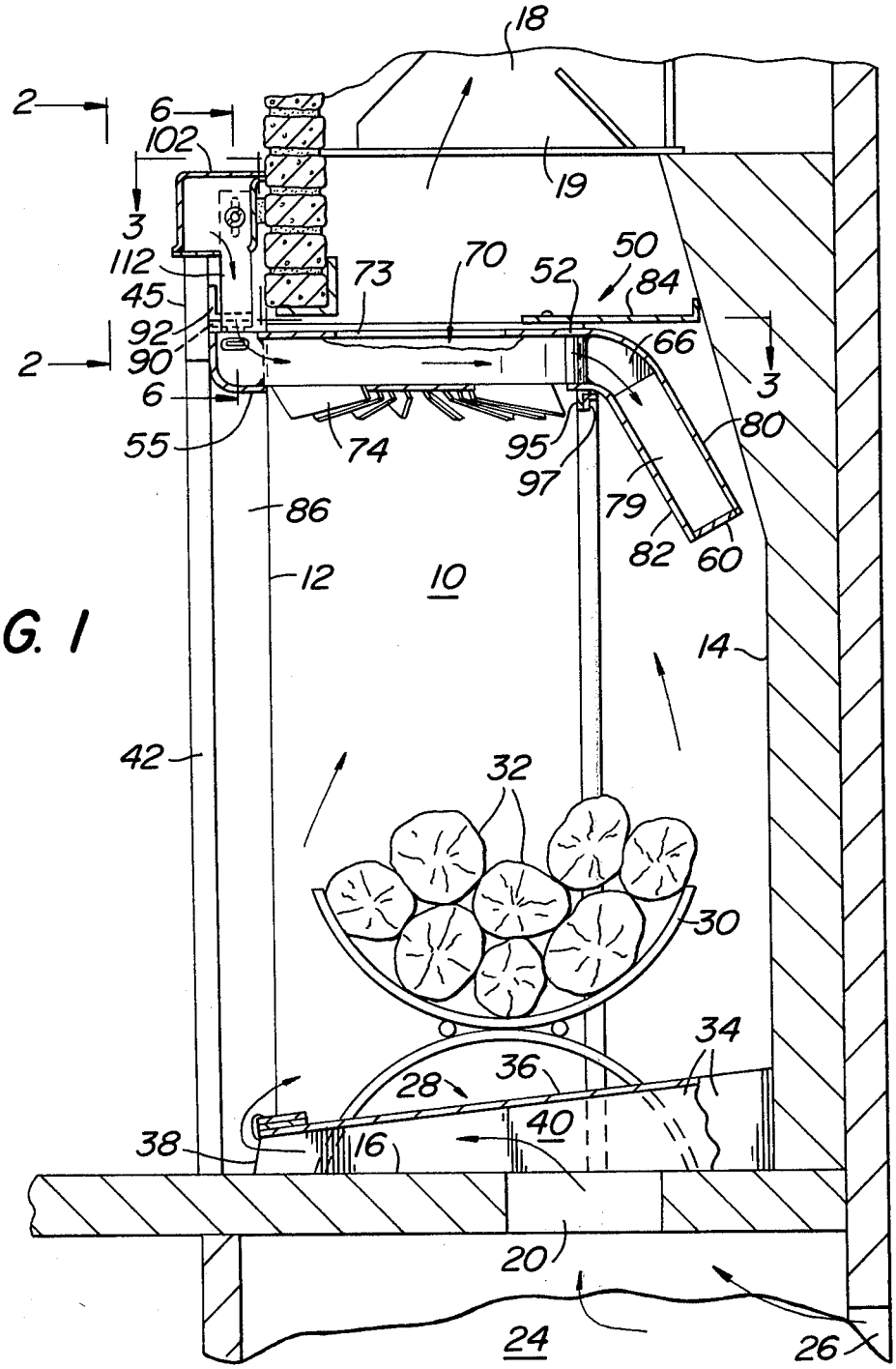
FIG. 1 is a vertical section through a fireplace provided with a room air heating system in accordance with the invention.
Figure 6:
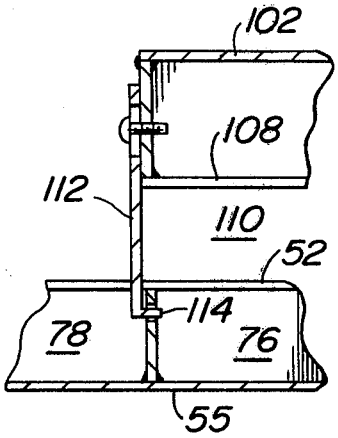
FIG. 6 is a fragmentary sectional view of a detail taken on line 6—6 of FIG. 1.

In FIG. 1 there is shown a typical fireplace comprising a combustion chamber 10 having a front opening 12, a back wall 14, a hearth 16 and a chimney flue 18 connected to a portion of the combustion chamber 10 through a damper-controlled passage 19 through which the combustion gases are discharged. As is conventional, an ashpit opening 20 is provided in hearth 16 leading to an ashpit 24 therebeneath. While it is conventional that ashpit opening 20 be provided with a door, it is preferable that this door be omitted when the fireplace is adapted for use with the system in accordance with the invention.

There is also provided means for supplying relatively cold air to hearth opening 20, such much comprising an air intake vent 26 through which outside air may flow into ashpit 24 for flow therefrom through hearth opening 20 to supply air for the combustion of the fire in the fireplace, this air flow being controlled by an air supply distributor 28.

There is provided some means for supporting logs, coals or other quantity of combustible products at a location spaced above hearth opening 20. As shown in FIG. 1, this means comprises a log holder 30 of a conventional construction adapted to support a plurality of logs 32 in a position spaced above hearth 16 and hearth opening 20. It will be apparent that the combustion products supporting means may take various forms such as a fireplace grate that may be used to support coals or the like.

Air distributor 28 is of the type described in detail in my copending application, Ser. No. 34,424, which is hereby incorporated by reference, and comprises a pair of side walls 34 and a top cover 36 formed by a single sheet of metal bent along two biased break lines. The front edge of distributor 28 defines a low, wide air flow discharge opening 38 and the back edge of the distributor is constructed to mate with a vertical back wall 14 of a typical fireplace in a manner to close off flow through the back opening thereof.

The distributor 28 is positioned as shown in FIG. 1 so that as air enters a flow distributing chamber 40 defined between the inside of the distributor 28 and hearth 16, the air will be directed forwardly to discharge through an opening 38 adjacent the fireplace front opening 12 and spaced slightly from a fire screen assembly 42 which closes the front opening 12 and includes glass doors 43. The outside air then flows forwardly and upwardly to supply combustion air for a fire provided in the combustion chamber 10 and to cool glass doors 43.

In accordance with the invention there is provided a generally box-shaped heat exchanger 50 and means for mounting same at the top portion of combustion chamber 10 to extend across the location whereat chimney flue 18 connects with the top portion of combustion chamber 10. This is the hottest region of the combustion chamber 10 when logs 32 are burning.

Heat exchanger 50 is made of all heavy gage aluminum parts secured together by aluminum welds to provide a highly heat conductive arrangement defining a first heat exchange passage for the flow of room air from the room into the top portion of the combustion chamber and back to the room, and a second heat exchange passage for the flow of combustion gases upwardly from combustion chamber 10 to chimney flue 18. The first and second heat exchange passages are arranged in heat exchange relationship so that the hot combustion gases passing from combustion chamber 10 to chimney flue 18 through the second heat exchange passage heat up the room air being circulated through the top portion of the combustion chamber through the first heat exchange passage.

The welded together aluminum parts of heat exchanger 50 comprises a top plate 52, a bottom plate 54 spaced apart from top plate 52, a pair of side plates 56 and 58 extending horizontally along the sides of heat exchanger 50, an arcuate end wall 60, a central cylindrical divider plate 62, a front baffle plate 64, and a rear baffle plate 66. All of these aluminum parts are welded together at their joining edge portions by aluminum welds as shown in the Drawings to provide a unitary aluminum structure which is light in weight and is comprised entirely of parts having good heat conductive properties.

The heat exchange passage for the combustion gases is indicated generally at 70 and is located centrally of the horizontal portion of heat exchanger 50 and within the inside wall of divider plate 62. The combustion gases flow upwardly from combustion chamber 10 and enter heat exchange passage 70 through a louvered bottom opening defined by a plurality of slots 72 formed in bottom plate 54. The combustion gases exit from heat exhange passage 70 by way of a centrally located circular top opening 73 in top plate 52. Suspended centrally in chamber 70 by means of mounting bolts 69 is a baffle plate 68 in the form of a disc and made from relatively low thermal conductivity and high heat resistant material such as thin gauge stainless steel. Baffle plate 68 will prevent the escape of gas directly from the slots 62 to the top opening 73 insuring better contact and increased dwell time with the divider plate.

By thermally isolating this thin baffle plate 68, it will achieve the maximum temperature of the hot exhaust gases and act as a catalytic converter to ignite any unburned flammable gases escaping the combustion chamber 10. As is best shown in FIGS. 3 and 4, there are provided sixteen circumferentially equally spaced slots 72, each of which extends radially from a circular area to terminate inside of divider plate 62. Each slot 72 is formed by stamping out on three sides a generally wedged shaped opening in bottom plate 54 to form a fin 74 which projects downwardly at an acute angle (approximately 30°) with bottom plate 54 from a radially extending bend line. The sixteen fins 74 are arranged to produce a swirling flow of the combustion gases flowing upwardly through heat exchange passage 70 in a counter-clockwise direction as viewed from the top of heat exchanger 50 (see the arrows in FIG. 5). This swirling flow is in the same direction as the Coriolis spin normally induced in upwardly flowing gases. This spinning effect will product a high velocity for good conduction of heat into the aluminum. It will also provide a "dwell" time in the heat exchanger. In other words, each cubic foot of hot gas will have more and better exposure to the heat transfer walls of the exchanger. Additionally the fins 74 will provide good surface exposure on both sides to pick up heat from these hot gases and conduct it into the bottom plate 54 of the room air heat exchange passage.

Additionally the spinning gases in the chamber 70 will have additional exposure to the hot catalytic element resulting in a secondary and more complete combustion. The spinning flow is accelerated by making the area of top opening 73 less than the total flow area of the bottom openings provided by the sixteen slots 72 in bottom plate 54.

Figure 7:
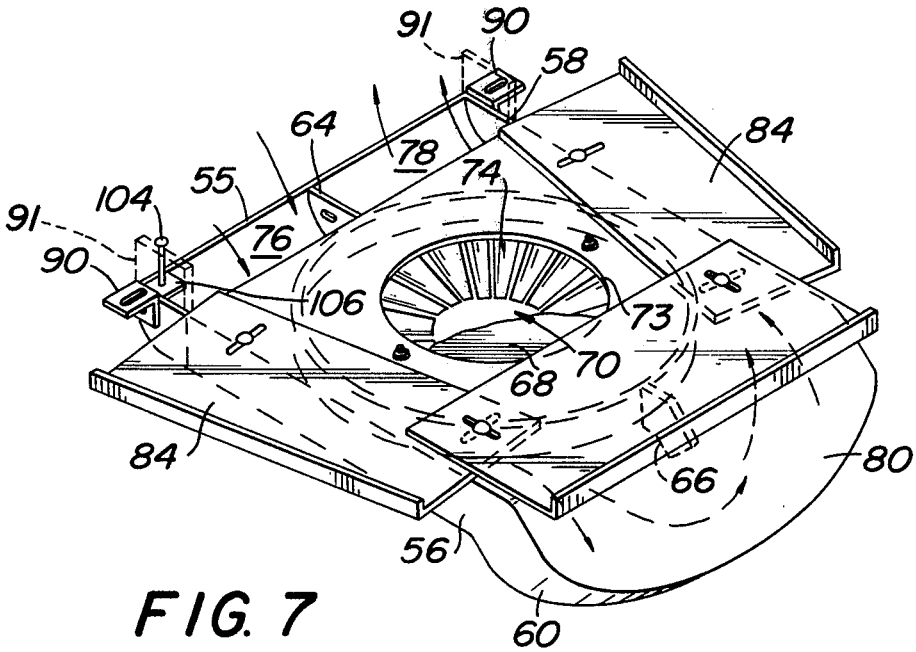
FIG. 7 is a perspective view of the heat exchanger shown in FIG. 1.

The various parts of heat exchanger 50 define a heat exchange passage for the circulating room air which passage extends around the exterior of heat exchange passage 70 by flowing along outside wall of divider plate 62 which is located between the heat exchange passages. To this end, bottom plate 56 has a front portion 55 which extends beyond the front edge of the top plate 62 and is bent upwardly as best shown in FIGS. 1 and 7. Front portion 55 cooperates with baffle 64 and the front portions of side walls 56 and 58 to define an inlet opening 76 and an outlet opening 78. The flow of room air through the passage therefor in heat exchange relationship with heat exchange passage 70 is shown by the arrows in FIG. 7. As shown in FIG. 7 the room air enters inlet opening 76, flows toward the back of the fireplace along one side of divider plate 62 and enters an arcuate chamber 79 in a downwardly projecting portion of the heat exchanger 50 defined by portions 80 and 82 of top and bottom plates 52 and 54, respectively, in cooperation with the arcuate wall 60. The room air flows around rear baffle plate 66 and returns toward the front of heat exchanger 50 passing along the opposite side of divider plate 62 to the outlet opening 78 through which the room air exits from heat exchanger 50.

It will be apparent that the room air flow is in effective heat exchange relationship with the combustion gas flow through heat exchange passage 70. In addition, the room air is in heat exchange relationship with the combustion gases flowing along the back wall 14 of combustion chamber 10 by reason of its flow through the downwardly projecting portion of heat exchanger 50 defining chamber 79 described above.

The aluminum parts of heat exchanger 50 are anodized flat black. This improves the heat transfer properties of the parts by improving the heat transfer coefficient thereof.

Means are provided for directing the upwardly flowing combustion gases toward heat exchange passage 70. To this end, three baffle sheets 84 are adjustably mounted on top plate 52 of heat exchanger 50. By the proper positioning on the sheets 84 laterally relative to the walls of the fireplace, such plates may be positioned as shown in FIG. 3, whereby the combustion gases are prevented from flowing along the sides and back end of heat exchanger 50. Accordingly, such gases are directed to flow upwardly through the centrally located heat exchange passage 70.

As is best shown in FIGS. 3 and 4, the fire screen assembly 42 extends across the front opening 12 of the fireplace to close off the same and preferably comprises tempered glass doors 43 which may be opened to provide access to combustion chamber 10. As is best shown in FIG. 1, the screen assembly is mounted to be spaced apart a short distance from the front face of the fireplace, a distance sufficient to allow the front portion 55 of heat exchanger 50 to extend forwardly of the front face on the fireplace (See FIG. 1). A pair of end strips 86 and 88 are provided to seal off the space between the vertical edges of fire screen assembly 42 and the front face of the fireplace. Strips 86 and 88 are made of contact adhesive backed light gage steel. The top mantle section 45 of the screen assembly defines an elongated passageway in the space between mantle section 45 and the opposing portion of the front face of the fireplace. This elongated space is used for the flow of room air into and out of the heat exchanger as will be described hereafter.

Heat exchanger 50 is mounted in a horizontally extending position at the top of combustion chamber 10 by an adjustable front mounting means which mounts the front of heat exchanger 50 on mantle section 45 of fire screen assembly 42 and a rear mounting means which supports a rear portion of heat exchanger 50 on the hearth 16. The front mounting means comprises a pair of angle brackets 90 (FIG. 7), each of which has a slotted top face and an end face secured to the side walls 56 and 58, of heat exchanger 50 by mounting screws as best shown in FIG. 7. The slotted top faces of brackets 90 are secured to cooperating brackets 92 on mantle section 45 by means appropriate mounting screws. The rear mounting means comprises a support in the form of an adjustable goal post comprising a pair of perforated angle iron vertical legs 94 and 96 adapted to be selectively bolted to horizontal angle iron supports 95 and 97, respectively, near their upper ends. Supports 95 and 97 are made of angle steel adapted to fit together telescopically to be bolted together at a desired position. The horizontal crossbar supports 95 and 97 are bolted to a rear portion of heat exchanger 50 as shown in FIG. 1 to support the heat exchanger 50 at this location. In this manner the rear portion of heat exchanger 50 is supported on the hearth 16 by a support system that is adjusted to fit the fireplace combustion chamber.

Fan means are provided for circulating room air through the room air heat exchange passage of heat exchanger 50 as described above. To this end, a fan 100 is mounted on the right end of a wand or elongated conduit 102 as viewed in FIG. 3. Fan 100 draws air from the room and delivers the room air into the end of wand 102. Wand 102 has a generally rectangular cross-section and is mounted at its bottom wall on top of fire screen assembly 42. Wand 102 is secured in position by a screw 104 engaged in a bracket 106 on heat exchanger 50 to extend vertically therefrom with its head projecting slightly above the top edge of fire screen assembly 42. The bottom wall of wand 102 is provided with a cutout 103 in the form of an elongated slot and a circular opening adapted to receive the head of the vertical screw 104 so as to engage the same as is shown in FIG. 3. Wand 102 has a discharge opening 108 in bottom wall thereof communicating with an inlet chamber 110 located in the space therebeneath between mantle section 45 and the front face of the fireplace. Inlet chamber 110 is located in the region above inlet 76 of heat exchanger 50. Wand 102 carries an adjustable end strip 112 which extends downwardly from the left end of the wand 102 (as viewed in FIG. 3) and has a hook 114 adapted to engage a slot in baffle 64. By this arrangement, end strip 112 closes off the left end of inlet chamber 110, the right end of which is closed off by end plate 88 of fire screen assembly 42 in a fireplace where the heat exchanger fits closely within the front opening of the fireplace. In order to close off the outside ends of the air passages on each side of strip 112 in fireplaces where the front opening is wider than the heat exchanger, there is preferably provided a pair of side closure plates 91 shown in dashed lines in FIG. 7 for clarity of illustration. Side closure plates 91 are secured to the front end of side walls 56 and 58, as by welding, and like strip 112 extend between mantle 45 and the front face of the fireplace to close off the inlet and outlet air passages. Side closure plates may be made vertically adjustable to accomodate different size mantles.

When fan 100 is operated it draws air from the room containing the fireplace and delivers the air into the right end of wand 102 (FIG. 3). The air flows through wand 102 and downwardly through discharge opening 108 into inlet chamber 110 therebeneath. From inlet chamber 110 the room air flows into inlet passage 76 of heat exchanger 50.

After passing through room air heat exchange passage of heat exchanger 50, the room air passes upwardly from outlet passage 78 into the space between mantle section 45 and the front face of the fireplace to the left of a strip 112 as viewed in FIG. 3. The heated room air flows back into the room through a screen 120 extending horizontally across the top edge of screen assembly 42 to the left of strip 112.

In the use of the fireplace system of the invention a fire burning in combustion chamber 10, such as the burning of logs 32 shown in FIG. 1, draws cold air through ashpit opening 20 into the air distributor chamber 40 thereabove. The distributor 28 deflects the incoming cold air forwardly through its front discharge opening 38 from which the air flows upwardly to provide the oxygen for supporting the combustion of the fire while at the same time cooling the glass screen assembly 42. The fire screen assembly 42 prevents room air from passing into the combustion chamber 10 so that the outside air is the sole source of oxygen for the burning fire. This provides a considerable energy savings since the use of room air to support the combustion of the firewood would require subsequent reheating of the room air by the heating system of the home.

In addition, the room air is heated by the heat exchanger 50 by the operation of the fan means to circulate the room air through the passage therefor in heat exchanger 50. To this end, the hot combustion gases flow upwardly through heat exchange passage 70 to heat up the heat exchanger 50 while the room air is circulated around the heat exchange passage 70 as previously described in heat exchange relationship with the hot combustion gases whereby the temperature of the room air is elevated as it passes through the highly conductive heat exchanger 50. This heated up room air is circulated back into the room through screen opening 120 as described above.

In accordance with the invention heat exchanger 50 provides a very efficient heat transfer action by reason of its heavy gage aluminum construction and by reason of the design of the flow passages for the room air and the combustion gases, including the baffles and louver fins. Fins 74 serve to swirl the combustion gases to increase their velocity and their travel path through the passage 70 to thereby increase their heating action. Also, the heat exchange action is improved by the flow of the room air through the downwardly extending portion of heat exchanger 50 at the rear location of the fireplace. Also, because of the aluminum weld construction, heat exchanger 50 will be heated throughout by conduction. This conduction heating is further increased by reason of the downwardly projecting fins 74 which serve as heat gathering elements.

It will be apparent that various changes may be made in the construction and arrangement of parts without departing from the scope of the invention.

I claim:

1. For use with a fireplace comprising a combustion chamber having a front opening and a back wall, a chimney flue connected to a top portion of the combustion chamber for discharging combustion gases therefrom, a hearth, an opening in the hearth, means for supplying relatively cold air to the opening in the hearth, a fire screen assembly or the like for closing off the front opening of the fireplace, and means for supporting a quantity of solid combustible product in the combustion chamber in a location spaced above the hearth opening, the combination comprising, a heat exchanger, means for mounting said heat exchanger at the top portion of the combustion chamber to extend horizontally across the location where said chimney flue connects with the top portion of the combustion chamber, said heat exchanger comprising means defining a first heat exchange passage for the flow of room air across the top portion of the combustion chamber, and means defining a second heat exchange passage for the flow of combustion gases vertically from said combustion chamber to said chimney flue, said first and second passages being in heat exchange relationship so that the hot combustion gases passing through said second heat exchange passage heat up the room air flowing through said first heat exchange passage, and fan means for circulating room air through said first heat exchange passage, said second heat exchange passage being located centrally of said heat exchanger and having a bottom opening communicating with the top of said combustion chamber and a top opening spaced above said bottom opening and communicating with said chimney flue whereby said combustion gases pass upwardly through the central portion of said heat exchanger, said first heat exchange passage extending around said second heat exchange passage in heat exchange relationship therewith, said heat exchanger including a bottom plate and a top plate spaced above said bottom plate, said bottom opening being formed in said bottom plate and said top opining being formed in said top plate, said bottom opening being formed by a plurality of circumferentially spaced, radially outwardly extending openings formed by a plurality of fins bent downwardly from said bottom plate, said top opening being formed by a circular opening in said top plate above said bottom opening, said fins extending downwardly at an angle so as to cause the combustion gases flowing upwardly from the combustion chamber and through said top opening to swirl in a counter-clockwise direction as viewed from the top of the heat exchanger, said top opening having a smaller area than said bottom opening to cause the flow of combustion gases to accelerate as said gases flow through said second heat exchange passage.

2. The combination according to claim 1 wherein said heat exchanger is made up of a unitary aluminum structure whereby said heat exchanger is light in weight and has good heat conducting properties.

3. The combination according to claim 1 wherein said fire screen assembly includes glass doors, and, said heat exchanger mounting means comprises means for releasably connecting the front end of said heat exchanger to said fire screen assembly and means for supporting the back end of said heat exchanger on said hearth including a pair of spaced apart upright legs joined with a horizontal support having the bottom of said heat exchanger supported thereon, whereby said heat exchanger is removable from said fireplace for cleaning or the like.

4. The combination according to claim 1 including an air flow distributor comprising a top cover and side walls defining a distribution chamber for receiving the flow of air passing upwardly through said hearth opening and directing said air to flow along the hearth for discharge from said air distributing chamber through an opening located at the front opening of the fireplace adjacent said fire screen assembly.

5. The combination according to claim 1 wherein said first heat exchange passage comprises a portion projecting downwardly toward the back wall of the combustion chamber to be contacted by the combustion gases flowing upwardly in this location of the combustion chamber.

6. The combination according to claim 1 wherein said fire screen assembly is positioned to be spaced forwardly from the front opening of said fireplace, the inlet of said first heat exchange passage being arranged to communicate with an inlet chamber defined between the upper portion of said screen assembly and the fireplace front, and including conduit means for directing the air discharged from said fan means to the inlet of said first heat exchange passage, said conduit means having a discharge opening communicating with said inlet chamber.

7. The combination according to claim 1 including a plate mounted in said second heat exchange passage to overlie said bottom opening to be exposed to said combustion gases flowing therethrough for causing secondary burning thereof, said plate comprising a disc made from a relatively low thermal conductivity and high heat resistance material.

8. For use with a fireplace, a heat exchanger adapted to be mounted across the top portion of the combustion chamber of the fireplace, said heat exchanger comprising means defining a first heat exchange passage for the flow of room air horizontally across the top of the combustion chamber, and means defining a second heat exchange passage for the flow of combustion gases vertically from said combustion chamber to the fireplace flue, said first and second passages being in the heat exchange relationship so that the hot combustion gases passing through said second heat exchange passage heat up the room air flowing through said first heat exchange passage, said second heat exchange passage being constructed and arranged to induce an accellerating rotating flow of the combustion gases about a vertical axis within said second passage and on discharge therefrom.

9. A heat exchanger according to claim 8 wherein said induced rotating flow of the combustion gases is in the same direction as that caused by the earth's Coriolis force.

10. A heat exchanger according to claim 8 including a plate-like element mounted in and to extend horizontally across said second heat exchange passage to be exposed to said combustion gases for causing secondary burning thereof, said element comprising a disc mounted to be substantially thermally insulated from said means defining said first and second heat exchange passage.

11. For use with a fireplace comprising a combustion chamber having a front opening and a back wall, a chimney flue connected to a top portion of the combustion chamber for discharging combustion gases therefrom, a hearth, an opening in the hearth, means for supplying relatively cold air to the opening in the hearth, a fire screen assembly or the like for closing off the front opening of the fireplace, and means for supporting a quantity of solid combustible product in the combustion chamber in a location spaced above the hearth opening, the combination comprising, a heat exchanger, means for mounting said heat exchanger at the top portion of the combustion chamber to extend horizontally across the location where said chimney flue connects with the top portion of the combustion chamber, said heat exchanger comprising means defining a first heat exchange passage for the flow of room air across the top portion of the combustion chamber, and means defining a second heat exchange passage for the flow of combustion gases vertically from said combustion chamber to said chimney flue, said first and second passages being in heat exchange relationship so that the hot combustion gases passing through said second heat exchange passage heat up the room air flowing through said first heat exchange passage, and fan means for circulating room air through said first heat exchange passage, said second heat exchange passage being located centrally of said heat exchanger and having a bottom opening communicating with the top of said combustion chamber and a top opening spaced above said bottom opening and communicating with said chimney flue whereby said combustion gases pass upwardly through the central portion of said heat exchanger, said first heat exchange passage extending around said second heat exchange passage in heat exchange relationship therewith, said heat exchanger having a generally box-like structure and being smaller than the width of a typical firplace, and including a plurality of baffle sheets mounted on said heat exchanger to extend across the width of the combustion chamber to block the flow of combustion gases along the outside of the heat exchanger so that the combustion gases are directed to flow through said bottom opening of said second heat exchange passage.

* * * * *